United States Patent [19]

Kolbe et al.

[11] Patent Number: 4,900,455

[45] Date of Patent: Feb. 13, 1990

[54] FINISHES FOR STABLE FIBERS OF SYNTHETIC POLYMERS

[75] Inventors: Joachim Kolbe; Ferdinand Kümmeler, both of Leverkusen; Rudolf J. Klee; Ralf Miessen, both of Dormagen, all of Fed. Rep. of Germany

[73] Assignee: Bayer Aktiengesellschaft, Leverkusen Bayerwerk, Fed. Rep. of Germany

[21] Appl. No.: 243,496

[22] Filed: Sep. 12, 1988

[30] Foreign Application Priority Data

Sep. 25, 1987 [DE] Fed. Rep. of Germany ..... 3732378

[51] Int. Cl.[4] ..... D06M 13/36

[52] U.S. Cl. ..... 252/8.8; 252/8.9; 252/8.7; 8/115.66; 8/115.56

[58] Field of Search ..... 8/115.6; 252/194, 8.8, 252/8.7, 8.6, 8.9

[56] References Cited

FOREIGN PATENT DOCUMENTS 1053403 1/1967 United Kingdom .

*Primary Examiner*—Paul Lieberman
*Assistant Examiner*—John F. McNally
*Attorney, Agent, or Firm*—Connolly & Hutz

[57] ABSTRACT

The invention relates to new finishing mixtures, which contain fatty acid alkanolamides having softening points above 70° C. as anti-blocking components, for synthetic fibers, particularly fibers of polyacrylonitrile, which are used as staple fibers. The invention also relates to the use of these finishing mixtures for the finishing of staple fibers, particularly polyacrylonitrile-based staple fibers.

12 Claims, No Drawings

FINISHES FOR STABLE FIBERS OF SYNTHETIC POLYMERS

The invention relates to new finishing mixtures, which contain fatty acid alkanolamides having softening points above 70° C. as anti-blocking components, for synthetic fibers, particularly fibers of polyacrylonitrile, which are used as staple fibers. The invention also relates to the use of these finishing mixtures for the finishing of staple fibers, particularly polyacrylonitrile-based staple fibers.

It is known that so-called finishes have to be applied to synthetic fibers to guarantee their subsequent processing to yarn. These finishes are generally applied after drawing or drying and before such further process steps as crimping and cutting. The effect of the finishes is based above all on an increase in surface conductivity which assists in reducing static charging, on an improvement in the sliding properties of the fibers, which reduces their stressing by the friction which they experience during subsequent processing at numerous contact points in the various processing machines, and on optimization of neutral fiber adhesion to ensure subsequent processing of the fibers at high working speeds.

Anionic preparations for polyacrylonitrile fibers generally consist of anionic antistaic agents and nonionic lubricants of various kinds. In many cases, the properties cannot be clearly differentiated because antistatic agents can also have certain lubricating properties while lubricants often contribute to surface conductivity and, hence, to antistatic finishing.

Thus, phosphoric acid and sulfuric acid esters of fatty alcohols or polyglycol ethers thereof are suitable antistatic agents. Alkanephosphonic acid semiesters or phosphorous acid esters have also been mentioned. In the case of phosphoric acid esters, it is possible to vary antistatic activity and lubricating properties within certain limits by combination of esterification components differing from one another in the length of the carbon chain or in the length of the polyether chain. The same also applies to the sulfuric acid esters.

Alkyl polyglycol ethers, fatty acid polyglycol esters, fatty acid alkyl esters, polyol fatty acid esters, paraffins or polyglycols are often used to support the lubricating properties. Thus, US-PS 4,072,617 for example describes inter alia phosphoric acid esters of fatty alcohols or ethoxylates thereof in combination with mineral oils and various polyglycol ethers. DE-A 1 469 426 claims saturated and unsaturated dialkylamides in combination with various ethylene oxide adducts.

Although finishes of the type in question are satisfactory in regard to antistatic activity and lubricating behavior, they are still often attended by the disadvantage that, in the production of yarn, the fibers finished with them stick or block on the corresponding units, mainly on pressure rollers or leather tapes. This effect occurs most frequently in rubbing frames or fliers and in ring spinning machines after prolonged stoppage times and/or in high-humidity working environments so that, when the units are started up again or even during final spinning of the fibers, yarn breaks and lapping occur, resulting in unwanted production stoppages.

It has now surprisingly been found that these disadvantages can be obviated by using finishing mixtures which, in addition to typical antistatic agents of the phosphoric acid or sulfuric acid ester type and Lubricants of the polyglycol ether or ester type, contain certain quantities of fatty acid monoalkanolamides having solidification points above 70° C. ("anti-blocking" components). These fatty acid monoalkanolamides may be represented by the following general formula:

$$R_1—CO—NH—R_2—OH$$

in which $R_1$—CO— represents acyl radicals of saturated $C_{14}$-$C_{22}$ fatty acids or mixtures thereof and $R_2$ represents —$CH_2$—$CH_2$—; —$CH_2$—$CH_2$—$CH_2$—; —$CH_2$—$CH(CH_3)$—.

After addition of these fatty acid monoalkanolamides to finishing mixtures of the type mentioned, it has been found that the tendency of fibers finished in accordance with the invention to stick to pressure rollers or leather tapes of the processing machines used to make yarn from the fibers is eliminated.

The present invention relates to finishing mixtures for synthetic fibers, particularly synthetic fibers of polyacrylonitrile, which are used as staple fibers, characterized in that the dry residue of the mixture contains at least 30% by weight phosphoric acid alkyl ester, preferably 30 to 70% and more preferably 40 to 60%, 0 to 30% sulfuric acid alkyl ester, 10 to 30% monoalkyl polyglycol ether or monoacyl polyglycol ester or mixtures thereof and 10 to 50% fatty acid monoalkanolamides corresponding to the following general formula $$R_1—CO—NH—R_2—OH$$

in which $R_1$—CO— represents acyl radicals of saturated $C_{14}$-$C_{22}$ fatty acids or mixtures thereof and $R_2$— represents —$CH_2$—$CH_2$—; —$CH_2$—$CH_2$—$CH_2$—; —$CH_2$—$CH(CH_3)$—.

Monoalkyl polyglycol ethers are understood to be ethoxylation products of monoalcohols while (mono)acyl polyglycol ethers are understood to be ethoxylation products of monocarboxylic acids.

Preferred finishing mixtures are characterized in that the dry residue contains - expressed in parts by weight of the dry residue 40 to 60% of a phosphoric acid ester obtained by reaction of 2 mol stearyl alcohol, an ethoxylation product of 1 mol stearyl alcohol and 8 to 12 mol and preferably about 10 mol ethylene oxide and i mol phosphorus pentoxide, neutralized with diethanolamine;

20 to 30% of an ethoxylation product of technical stearic acid containing 7.5 to 10 mol and preferably around 8.5 mol-% ethylene oxide and 20 to 30% stearic acid monoethanolamide.

The stearic acid monoethanolamide may contain palmitic and stearic acid ethanolamide, corresponding to technical stearic acid.

The finishing mixtures are further characterized in that the phosphoric acid esters are mixtures of monoesters and diesters of the type obtained by reaction of approximately 3 mol alcohol or polyglycol ethers thereof or mixtures thereof with 1 mol phosphorus pentoxide, optionally followed by neutralization.

The present invention also relates to the use of finishing mixtures of the type described above for the finishing of polyacrylonitrile fibers, particularly those which are processed to staple fibers, the finish being applied to the fibers before drying and crimping by immersion, spray or one-way finishing in quantities of 0.1 to 0.5%.

The antistatic agents based on phosphoric acid esters are mixtures of phosphoric acid mono- and diesters of the type obtained in known manner by reaction of approximately 3 mol compounds containing OH groups with 1 mol phosphorus pentoxide. The OH-containing compounds used may consist of saturated, aliphatic $C_4$–$C_{18}$ alcohols or polyglycol ethers thereof obtained by addition of 1 to 50 mol and preferably 7 to 25 mol ethylene oxide or of mixtures of such OH compounds. Sodium hydroxide, potassium hydroxide or alkanolamines, such as mono-, di- or triethanolamine, are preferably used for neutralization.

The sulfatization products of preferably saturated $C_8$–$C_{22}$ fatty alcohols or polyglycol ethers thereof obtained by addition of 1 to 50 mol ethylene oxide per mol alcohol are mentioned as examples of antistatic agents based on sulfuric acid esters. Sodium hydroxide, potassium hydroxide or alkanolamines, such as monoethanolamine, diethanolamine or triethanolamine, may be used for neutralization.

The lubricants include, above all, ethoxylation products of aliphatic $C_{12}$–$C_{22}$ fatty acids, such as for example lauric acid, palmitic acid, stearic acid, arachic acid, behenic acid or mixtures of these acids of the type formed in the refining of natural vegetable or animal fats. Saturated aliphatic $C_{16}$–$C_{22}$ alcohols reacted with 4 to 50 mol ethylene oxide may also be used.

Reaction products of technical stearic acid with 6 to 10 mol ethylene oxide are particularly suitable.

The fatty acid monoalkanolamides used in the mixture in accordance with the invention may be prepared in known manner, for example by reaction of fatty acids, fatty acid alkyl esters or fatty acid glycerides with monoalkanolamines at relatively high temperatures, for example at temperatures of 140° to 180° C., preferably in vacuo, with elimination of an equivalent quantity of water or alcohols. Since the alkanolamides used are high-melting types having solidification points, above 70° C., the choice of fatty acids is limited to saturated types containing 16 to 22 carbon atoms, such as for example palmitic acid, stearic acid, arachic acid, behenic acid or mixtures of these acids of the type obtained in the refining of natural fats. The alkanolamines used include, in particular, 2-aminoethanol, 3-amino-1-propanol and 1-amino-2-propanol.

The finishes according to the invention are prepared by mixing the components in the molten state and adding the corresponding quantity of hot water. It is possible in this way to prepare mixtures which, depending on their solids content, are liquid or pasty at room temperature. In some cases, however, the mixtures may also be prepared in anhydrous form, for example—using roller units—in the form of flakes which can be readily emulsified in hot water and afford particular advantages in terms of handling and logistics.

In general, the finishes are applied to the fibers after drawing in the form of dispersions or emulsions by any of various finishing techniques. Immersion finishing using a solution having a solids content of approximately 1% has been successful. The amount of finish applied may be controlled through the concentration of the bath and the squeezing effect, corresponds to typical quantities and should preferably be between 0.1 and 0.5%, depending on the filament liter. In addition to immersion finishing, the finishes may also be applied by spraying or by passing the tow past a slot die. After finishing, subsequent processing takes place in the usual way by drying, crimping and cutting.

The synthetic fibers used are preferably polyacrylonitrile fibers containing at least 50% by weight, preferably at least 85% by weight and more preferably at least 91% by weight of acrylonitrile in addition to the usual co-monomers.

Examples of phosphoric acid esters:

A 1: The reaction product of 2 mol stearyl alcohol, 0.5 mol i-nonylphenol + 10 mol ethylene oxide, 0.5 mol n-butanol and 1 mol phosphorus pentoxide, neutralized with diethanolamine.

A 2: The reaction product of 2 mol steary alcohol, 0.5 mol (R) Dobanol 23 containing 10 mol ethylene oxide, 0.5 mol n-butanol and 1 mol phosphorus pentoxide, neutralized with diethanolamine.

A 3: The reaction product of 2 mol stearyl alcohol, 1 mol stearyl alcohol containing 10 mol ethylene oxide and 1 mol phosphorus pentoxide, neutralized with diethanolamine.

Examples of lubricants:

B 1: The reaction product of 1 mol technical stearic acid and 8.5 mol ethylene oxide. The technical stearic acid contains around one third palmitic acid and around two thirds stearic acid.

Examples of the "anti-blocking" components used in accordance with the invention (with "anti-lap" properties)

C 1: Stearic acid monoethanolamide: (SP 92.5° C.)

C 2: Stearic acid monopropanolamide: (SP 83.5° C.)

C 3: Stearic acid monoisopropanolamide: (SP 74° C.)

(SP = solidification point)

Examples of sulfuric acid esters:

D 1: The reaction product of acetyl alcohol with 8 mol ethylene oxide, sulfatized with 1 mol chlorosulfonic acid, is neutralized with diethanolamine (sulfuric acid alkyl ester).

Laboratory method for testing the adhesion (bond strength) of finish films:

The finish sample is carefully dehydrated in vacuo. The anhydrous melt is applied in a layer thickness of 2 mm to an 8 cm diameter Petri dish. The melt is allowed to solidify and the Petri dish is stored in a conditioned room at 23° C./50% relative humidity.

The following apparatus is used to measure adhesive strength:

The Petri dish containing the solidified finish film is situated on a lifting table. A cylindrical test specimen (fine steel) 20 mm in diameter and weighing 33 g is placed on the finish film. After 10 minutes under load, the test specimen is suspended loosely from a Perlon wire which passes through the rollers of a Schlafhorst balance and is attached to a fixed point above the balance. The Petri dish is then lowered by the lifting table. The Perlon wire is placed under tension and, as the test specimen separates from the finish film, a different adhesive strength is obtained according to the finish film, corresponding to the maximum deflection of the Schlafhorst friction balance reduced by the weight of the test specimen. The measurements are carried out after 3 and 10 days at 23° C./50% relative humidity.

| Results | | | |
|---|---|---|---|
| | Finish film | Adhesive strength in cN after 3 days | Adhesive strength in cN after 10 days |
| M 1* | 100% A 1 | 30 | 30 |
| 2* | 70% A 1 + 30% B 1 | 20 | 200 |
| 3 | 50% A 1 + 25% B 1 + 25% C 1 | 0 | 11 |
| 4* | 100% A 2 | 32 | 47 |
| 5* | 70% A 2 + 30% B 1 | 34 | 160 |
| 6 | 50% A 2 + 25% B 1 + 25% C 1 | 0 | 7 |
| 7* | 100% A 3 | 3 | 5 |
| 8* | 70% A 3 + 30% B 1 | 20 | 127 |
| 9 | 50% A 3 + 25% B 1 + 25% C 1 | 0 | 0 |
| 10 | 36% A 1 + 48% B 1 + 16% D 1 | 7 | 107 |

*Mixtures 1, 2, 4, 5, 7, 8 and 10 are comparison tests.

The finish according to the invention corresponding to mixture 9 was prepared as follows:

50.0 kg phosphoric acid ester A 3 were melted together with 25.0 kg lubricant B 1and 25.0 kg anti-blocking component C 1 and the resulting melt stirred with 400.0 kg fully deionized water at 95° to 98° C. When a homogeneous emulsion had been formed, it was cooled with stirring to room temperature. A liquid, stable emulsion having a solids content of 20% is obtained.

Adhesive strength in cN of finishes M 9 and M 10 for various water contents (in the emulsion)

| Finish component | M 10 (comparison) | M 9 (invention) |
|---|---|---|
| 100% | 35 | 0 |
| 90% | 57 | 0 |
| 80% | 117 | 43 |
| 70% | >250 | 65 |
| 60% | >250 | 97 |
| 50% | >250 | 83 |

Performance testing

The following procedures adopted to evaluate the tendency of fibers treated with various finishes towards lapping:

The various finishes are applied in a suitable quantity and by standard methods, for example at standard process stages, in the manufacture of polyacrylonitrile fiber. Thus, the finish may be applied as an immersion finish after washing and drawing before the dryer or, after drying, by spraying or, after crimping, by (partial) spray application. At the same time, the crimping conditions are adapted to the particular finishes, so that optimal crimp intensities (not too high and not too low tow adhesion) are obtained for the final spinning of the fibers. The fibers are processed in the usual way to flyer bobbins. The "anti-lap" qualities of the various finishes are then tested using these flyer bobbins. To this end, the following procedure is adopted:

The flyer bobbins of acrylonitrile fibers, such as (R)Dralon, for example with two different finishes, are fine-spun on one and the same ring spinning machine. To obtain significant results in regard to any lapping tendency for reasonable outlay, it is advisable to establish critical conditions for the fine-spinning process. By critical conditions are meant conditions under which lapping frequently occurs on pressure rollers or leather tapesof the ring spinning machine. Critical conditions are established by using ambient atmospheres of high moisture content (humid and warm) or, alternatively, by restarting the ring spinning machine after a prolonged stoppage (for example overnight) and, in addition, by switching off the conditioning plant in a cold, humid external environment or under humid climatic conditions differing from the normal conditions. Under correspondingly critical conditions, finishes showing a tendency towards lapping show up to 100% yarn breaks on restarting or intensive slub formation in the yarn at numerous spinning stations. The intensity of lapping (yarn break, slub or no slub) is determined not only by the properties of the finish, but also by the fine-spinning conditions (climate, standing time, compressive forces, machine type, etc.). Accordingly, comparisons of the lapping tendency of finishes are only ever allowed as relative comparisons. The results of test series carried out at different times must not be compared with one another.

In the relative comparison of the lapping tendency of finishes under selected critical final spinning and initial spinning conditions, the following data are recorded and compared with one another:

1. Thread breaks

A considerable or large number of thread breaks is indicative of a considerable risk of thread breaks and lapping in the normal operation of a spinning machine. If lapping simultaneously occurs on the transport elements, corresponding finishes are unsuitable.

2. Slubs

If numerous slubs rather than thread breaks occur during initial spinning without the thread actually breaking, the corresponding finish, although less susceptible to lapping problems in the normal operation of a spinning machine, is nevertheless far from optimal.

3. Fiber deposits or lap deposits on the clearer roller and on the pressure rollers. These provide additional information on the lapping tendency of a finish (because the laps can be counted both on the clearer roller and on the pressure rollers, theoretical values of 200% can be reached).

EXAMPLE

Polyacrylonitrile fibers prepared by dry spinning were finished on the one hand with the finish M 10 (comparison) and on the other hand with the finish M 9 (invention). The titer or staple of the fibers was 2.2/50 brt. Yarn quality (count 60/1) was tested under normal final-spinning conditions by determination of tenacity $R_H$, breaking elongation $\epsilon_H$ and the Classimat defects per 100,000 m. In particular, the finishes were tested for their tendency towards lapping, i.e. for their behavior on restarting of the ring spinning machine after a weekend stoppage. The climate prevailing during the weekend stoppage was one of 25° C. and 70% relative humidity (rH) and, 1 hour before restarting was changed to the standard working environment of 22° C./55% rH. In the interests of reproducibility, two tests (A, B) were carried out with freshly produced and finished fibers:

| Finish | M 10 | | M 9 | |
|---|---|---|---|---|
| Test | A (comparison) | B | A (invention) | B |
| Quantity of finish applied | | | | |
| Classimat values | | | | |
| Disruptive defects | 19 | 4 | 2 | 7 |
| Total defects | 70 | 32 | 21 | 25 |
| $R_H$ cN/ted | 14.4 | 14.1 | 14.3 | not measured |
| $\epsilon_H$ % | 18.6 | 18.6 | 17.7 | not measured |

-continued

| Finish | M 10 | | M 9 | |
|---|---|---|---|---|
| Test | A (comparison) | B | A (invention) | B |
| Thread breaks %[1] | 9 | 6 | 0 | 0 |
| Slubs %[1] | 60 | 52.5 | 17.5 | 2.5 |
| Lap deposits %[2] | >50 | >50 | 10 | 0 |

[1]% of the stations of a spinning machine

[2]% of the lap deposits on pressure rollers and on clearer rollers

The laboratory method of measuring adhesive strength shows a good correlation with the anti-lap results of the finishes according to the invention on fibers.

We claim:

1. Finishing mixtures for synthetic fibers characterized in that the dry residue of said mixtures contains at least 30% by weight phosphoric acid alkyl ester, 0 to 30% sulfuric acid alkyl ester, 10 to 30% monoalkyl polyglycol ether or monoacyl polyglycol ester or mixtures thereof and 10 to 50% fatty acid monoalkanolamides corresponding to the following general formula $$R_1—CO—NH—R_2—OH$$

in which $R_1$—CO— represents acyl radicals of saturated $C_{14}$-$C_{22}$ fatty acids or mixtures thereof and $R_2$— represents —$CH_2$—$CH_2$—; —$CH_2$—$CH_2$—$CH_2$—; —$CH_2$—$CH(CH_3)$—.

2. Finishing mixtures as claimed in claim 1, characterized in that the dry residue contains: (expressed in parts by weight of the dry residue):

40 to 60% of a phosphoric acid ester from the reaction of 2 mol stearyl alcohol, an ethoxylation product of 1 mol stearyl alcohol and 8 to 12 mol ethylene oxide and 1 mol phosphorus pentoxide, neutralized with diethanolamine, 20 to 30% of an ethoxylation product of technical stearic acid containing 7.5 to 10 mol-% ethylene oxide and 20 to 30% stearic acid monoethanolamide.

3. Finishes as claimed in claim 1, characterized in that the phosphoric acid esters are mixtures of mono and diesters of the type formed by reaction of approximately 3 mol alcohol or polyglycol ethers thereof or mixtures thereof with 1 mol phosphorus pentoxide, optionally followed by neutralization.

4. Finishes as claimed in claim 1, characterized in that the phosphoric acid esters are formed by reaction of approximately 3 mol saturated aliphatic $C_4$-$C_{18}$ alcohols or polyglycol ethers thereof, obtained by addition of 1 to 50 mol ethylene oxide with the above-mentioned alcohols, or of mixtures of such compounds with 1 mol $P_2O_5$ and subsequent neutralization with NaOH, KOH or alkanolamines.

5. Finishes as claimed in claim 1 wherein said fibers are polyacrylonitrile fibers.

6. Finishes as claimed in claim 5 wherein said polyacrylonitrile fibers are used as staple fibers.

7. Finishes as claimed in claim 1 wherein said residue contains 30 to 70% by weight phosphoric acid alkyl ester.

8. Finishes as claimed in claim 1 wherein said residue contains 40 to 60% by weight of phosphoric acid alkyl ester.

9. Finishes as claimed in claim 2 wherein about 6 to 10 mol ethylene oxide are reacted to produce said phosphoric acid ester.

10. Finishes as claimed in claim 2 wherein said ethoxylation product of technical stearic acid contains approximately 8.5 mol - % ethylene oxide.

11. A method of finishing polyacrylonitrile fibers which are processed to staple fibers comprising applying the finish as claimed in claim 1 to said fibers.

12. A method of finishing polyacrylonitrile fibers which are processed to staple fibers comprising applying the finish claimed in claim 1 to said fibers by immersion, spray or one-way finishing in quantities of 0.1 to 0.5% before drying or crimping.

* * * * *